US007087353B2

(12) United States Patent
Mikuriya et al.

(10) Patent No.: US 7,087,353 B2
(45) Date of Patent: Aug. 8, 2006

(54) NON-CONTACT HEAT FIXING TONER

(75) Inventors: Yoshihiro Mikuriya, Nishinomiya (JP); Minoru Nakamura, Takarazuka (JP); Masahiro Anno, Hachioji (JP); Junichi Tamaoki, Sakai (JP); Chiyoshi Nozaki, Otsu (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 213 days.

(21) Appl. No.: 10/697,236

(22) Filed: Oct. 31, 2003

(65) Prior Publication Data

US 2004/0142263 A1 Jul. 22, 2004

(30) Foreign Application Priority Data

Nov. 1, 2002 (JP) ..... 2002-320003

(51) Int. Cl.
*G03G 9/087* (2006.01)

(52) U.S. Cl. ..... 430/108.2; 430/108.8; 430/109.1; 430/109.4

(58) Field of Classification Search ..... 430/108.2, 430/108.8, 109.1, 109.4
See application file for complete search history.

(56) References Cited

U.S. PATENT DOCUMENTS

| | | | | |
|---|---|---|---|---|
| 6,528,221 | B1 | 3/2003 | Takezawa et al. | |
| 6,593,050 | B1 | 7/2003 | Katagiri et al. | |
| 6,852,461 | B1 * | 2/2005 | Sato et al. | 430/109.4 |
| 2004/0185364 | A1 * | 9/2004 | Kanamaru et al. | 430/109.1 |

FOREIGN PATENT DOCUMENTS

| | | |
|---|---|---|
| JP | 2000-284529 | 10/2000 |
| JP | 2001-22127 | 1/2001 |
| JP | 2001-92174 | 4/2001 |
| JP | 2002-99111 | 4/2002 |

* cited by examiner

*Primary Examiner*—Mark A. Chapman
(74) *Attorney, Agent, or Firm*—Buchanan Ingersoll PC

(57) ABSTRACT

A non-contact heat fixing toner, comprising a binder resin, a colorant, an infrared absorbing agent, a first wax and a second wax, wherein a difference (X-Y) between the maximum peak temperature (X; ° C.) in the differential thermal curve in the first wax and Tg (Y; ° C.) of the binder resin is within the range from −5 to +10° C.

19 Claims, 1 Drawing Sheet

NON-CONTACT HEAT FIXING TONER

This application is based on application(s) No. 2002-320003 filed in Japan, the contents of which are hereby incorporated by reference.

BACKGROUND OF THE INVENTION

1. Field of the Invention

The present invention relates to a toner used for developing an electrostatic latent image formed by an electrophotographic method, an electrostatic recording method or the like, and more particularly concerns a toner that has a superior fixing property, and is suitably applied to a non-contact heat fixing device.

2. Description of the Related Art

With respect to the method for heat-fixing a toner image on copying paper, there are basically two methods, that is, a contact heat fixing system and a non-contact heat fixing system. The non-contact heat fixing system is a fixing system in which upon fixing, no members contact an image made from toner powder, and mainly classified into a flash fixing system and an oven (atmosphere) fixing system.

In the flash fixing system, a powder toner image, transferred onto copying paper from a photosensitive member or an intermediate transferring member, is irradiated with flash light from, for example, a xenon lamp, a halogen flash lamp or the like so that the toner image is fused by the radiation heat, and fixed onto the copying paper.

In the oven fixing system, a powder toner image, transferred onto copying paper from a photosensitive member or an intermediate transferring member, is irradiated with infrared rays under an oven atmosphere so that the toner image is fused by the radiation heat, and fixed onto the copying paper.

These non-contact heat fixing systems have the following superior features.

Since the powder toner image is fused and fixed without contacting any members, the toner image is free from damages caused by those members so that upon developing, there is no degradation in the resolution.

Since the fixing time is very short, a high-speed fixing process is available.

Since no waiting time is required for the fixing process, it is possible to start the process quickly.

These systems are readily applied to various kinds of copying paper having different thicknesses and qualities.

Here, since the non-contact heat fixing system carries out a heat fixing process in a non-contact state, its ambient energy dissipation is great. From the environmental viewpoint, there have been demands for a reduction in fixing energy. However, the total amount of light energy to be applied to the powder toner image tends to become insufficient. Consequently, the powder toner image is not sufficiently fused, resulting in failure to provide sufficient fixing characteristics. In particular, in the case of a full-color image in which black images and color images are simultaneously printed, since the amount of energy to be absorbed is different depending on the respective colors, it is very difficult to control the amount of energy to be applied.

For this reason, in order to achieve a sufficient melt-fixing process, for example, the following toners have been proposed: a color toner containing at least a binder resin, an infrared absorbing agent, a colorant and a specific ester-based compound (for example, see Japanese Patent Application Laid-Open No. 2001-22127 and Japanese Patent Application Laid-Open No. 2001-92174); a flash-fixing toner, which relates to a flash-fixing toner that is used for an image having toners of three colors or more laminated thereon, and contains an infrared absorbing pigment the absorbance in 650 nm of which is set to not more than 10% of the absorbance in the spectrum absorbing maximum wavelength in the infrared range, and which is characterized by containing at least two kinds of infrared absorbing pigments which have absorbing maximum wavelengths that deviate from each other by not less than 20 nm (see Japanese Patent Application Laid-Open No. 2002-99111); and a flash fixing toner composition which contains at least a binder resin, a colorant and a wax component as essential components, with the melt viscosity of the binder resin at 100° C. being set in the range of $1\times10^4$ to $5\times10^5$ Pa•S and the melt viscosity of the wax at 80° C. being set in the range of $1\times10^3$ to $1\times10^4$ Pa•S (Japanese Patent Application Laid-Open No. 2000-284529).

However, even the above-mentioned toners have failed to provide sufficient fixing properties and sufficient image quality depending on types and fixing conditions of images. For example, in the case of insufficient fixing properties, there is a reduction in the fixing strength in the resulting image, and when copy paper bearing an image formed on at least one surface thereof is fed, the fixed image tends to be rubbed against a roller or the like to cause degradation in the image quality such as blurring or stains (degradation in the smearing preventive property). Insufficient image-forming properties tend to cause fogging and the subsequent failure in properly reproducing desired colors, dots and fine lines. Heat resistance tends to deteriorate upon storage of the toner.

In particular, in the case when the fixing energy is small, degradation in the toner fixing property becomes conspicuous.

SUMMARY OF THE INVENTION

One objective of the present invention is to provide a non-contact heat fixing toner which exerts sufficient fixing property and image quality, even when the fixing energy is comparatively small.

Another objective of the present invention is to provide a non-contact heat fixing toner which exerts sufficient fixing property and image quality, even when the fixing energy is comparatively small, and which also provides an image that is superior in fixing strength, smearing preventive property, color reproductibility, dot reproducibility, fine-line reproducibility and heat resistance, and free from fogging.

Still another objective of the present invention is to provide an image-forming method which provides an image that is superior in fixing property and image quality even when the fixing energy is comparatively small.

The present invention relates to a non-contact heat fixing toner which contains at least a binder resin, a colorant, an infrared absorbing agent, a first wax and a second wax, and is characterized in that a difference (X-Y) between the maximum peak temperature (X; ° C.) in the differential thermal curve in the first wax and Tg (Y; ° C.) of the binder resin is set within the range of −5 to +10° C.

The present invention also relates to an image-forming method that is characterized by using the above-mentioned non-contact heat fixing toner.

DETAILED DESCRIPTION OF THE INVENTION

Figure 1:
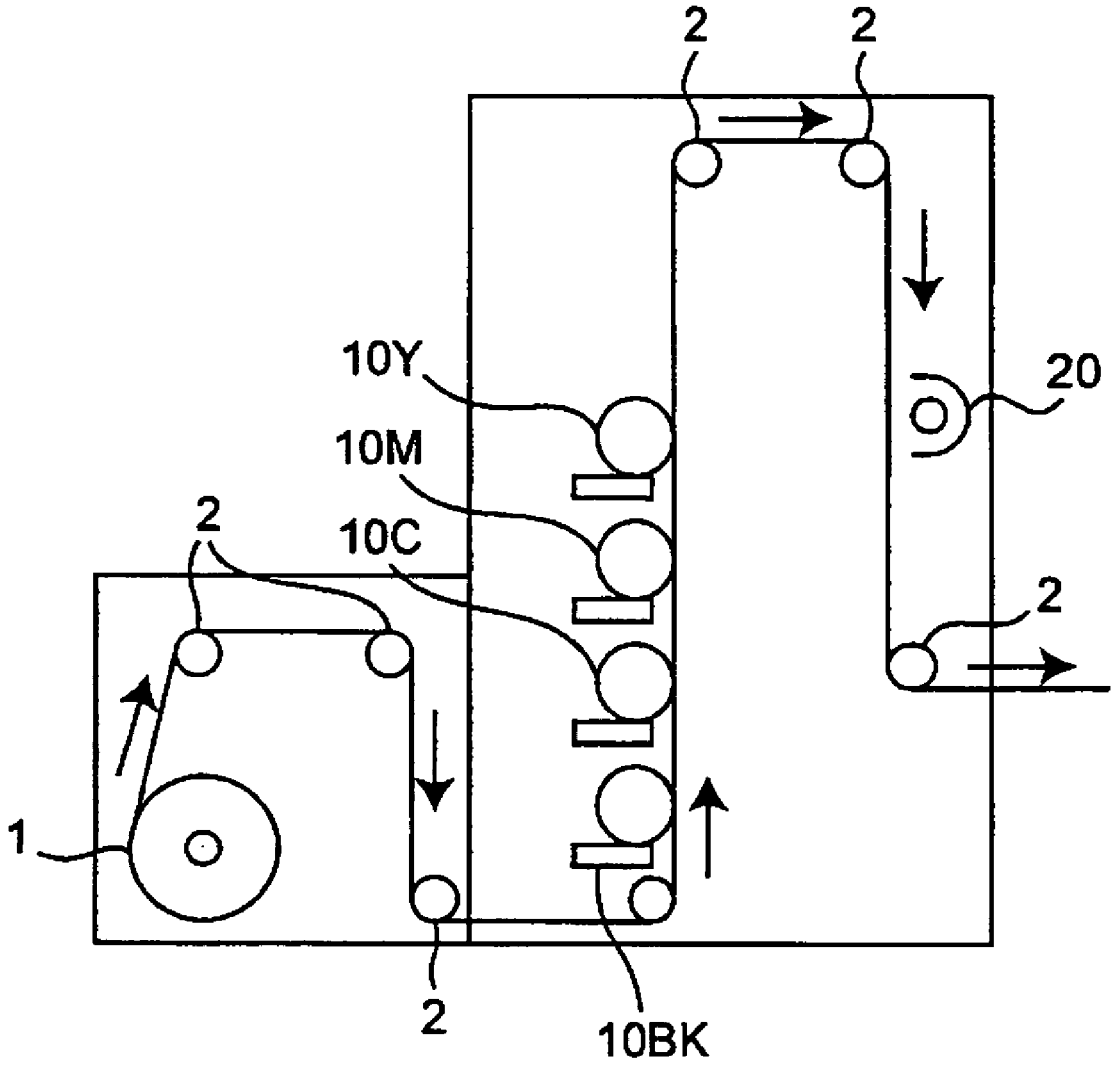
FIG. 1 is a schematic block diagram that shows a full-color image-forming apparatus having a non-contact fixing system to which toner of the present invention is suitably applied.

The invention of the present invention have studied hard to improve the fixing property of a non-contact heat fixing system, and found that the addition of a wax having a melting point that is virtually in the same level as the glass transition point of a binder resin makes it possible to sufficiently fuse the toner even when energy dissipation to the surroundings is comparatively great, and consequently to improve the fixing property of the toner.

In the present specification, the fixing property refers to a fixing property with respect to a non-contact heat fixing toner, and this term is used in a manner so as to include the fixing strength and smearing preventive property.

The non-contact heat fixing color toner of the present invention contains at least a binder resin, a colorant, an infrared absorbing agent, a first wax and a second wax.

With respect to the binder resin of the present invention, for example, polyester-based resin, styrene-based resin and the like are used. With respect to the polyester-based resin, a polyester resin, prepared by condensation-polymerizing a polyhydroxy alcohol component and a polycarboxylic acid component, can be applied.

Among polyhydroxy alcohol components, examples of dihydric alcohol components include: bisphenol A alkylene oxide additives, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxphenyl)propane and polyoxyethylene(2,0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polytetramethylene glycol bisphenol A and hydrogenized bisphenol A.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among polycarboxylic acid components, examples of dihydric carboxylic acid components include: maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, isooctenyl succinic acid, n-octyl succinic acid, isooctyl succinic acid, and anhydrides or lower alkyl esters of these acids.

Examples of trihydric or more carboxylic acid components include: 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, empol trimer acid, anhydrides or low alkyl esters of these acids.

In the present invention, with respect to the polyester-based resin, a resin obtained by the following processes is preferably used: that is, a mixture of a material monomer for a polyester resin, a material monomer for a vinyl-based resin and a monomer that reacts with both of the material monomers for the resins is used and a polycondensing reaction for obtaining the polyester resin and a radical polymerization reaction for obtaining a styrene-based resin are carried out in parallel with each other to obtain the resin in the same container. Here, the monomer that reacts with both of the material monomers for the resins refers to a monomer which is applicable to both of the polycondensing reaction and radical polymerization reaction. In other words, this monomer has a vinyl group that undergoes a radical polymerization reaction with a carboxy group that is allowed to undergo a polycondensing reaction, and examples thereof include fumaric acid, maleic acid, acrylic acid and methacrylic acid. With respect to the material monomer for the polyester resin, examples thereof include the above-mentioned polyhydroxy alcohol components and polycarboxylic acid components.

Examples of the raw-material monomer for the vinyl-based resin include: styrene or styrene derivatives, such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene, methacrylic acid alkyl esters, such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate and dodecylmethacrylate; methacrylic acid alkyl esters, such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate, and dodecylmethacrylate; acrylic acid alkyl esters, such as methylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate, and dodecylacrylate; unsaturated carboxylic acids, such as acrylic acid, methacrylic acid, itaconic acid and maleic acid; acrylonitrile, maleic acid ester, itaconic acid esters, vinyl chloride, vinylacetate, vinylbenzoate, vinylmethylethylketone, vinylhexylketone, vinylmethylether, vinylethylether, and vinylisobutylether. Examples of polymerization initiators used upon polymerizing the material monomers for the styrene-based resin include azo or diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile; and peroxide polymerization initiators such as benzoyl peroxide, methylethylketone peroxide, isopropylperoxycarbonate and lauroyl peroxide.

In the present invention, with respect to the above-mentioned binder resin, those resins having a glass transition point (Tg) in the range of 55 to 75° C., preferably, 55 to 65° C., more preferably, 60 to 65° C., are preferably used. When Tg is too low, the heat resistance tends to deteriorate. When Tg is too high, the fixing properly and in particular, the fixing intensity and color reproducibility, tend to deteriorate.

In an attempt to further improve the fixing property, the binder resin preferably has a softening point (Tm) in the range of 90 to 110° C., more preferably, 100 to 110° C.

In the present invention, in particular, in order to improve the fixing property, or in order to control the gloss of an image with respect to color toners requiring a light-transmitting property, it is preferable to use two kinds of polyester-based resins having different softening points with respect to the above-mentioned polyester-based resin. In the case when such two kinds of polyester-based resins having different softening points are used, the resulting mixed resin serving as the binder resin has two peaks in its molecular-weight distribution of the number-average molecular weight. When two kinds of polyester-based resins are used, Tg of the mixed resin is set in the above-mentioned range, and Tm of the mixed resin is preferably set in the above-mentioned range.

More specifically, in order to improve the fixing property, it is preferable to use a first polyester resin having a softening point in the range from 90 to 120° C. and a second polyester resin having a softening point in the range from 115 to 145° C. More preferably, the softening point of the first polyester-based resin is set in the range from 90 to 110° C., and the softening point of the second polyester-based resin is set in the range from 120 to 140° C.

With respect to the first polyester-based resin, a polyester resin, obtained by polycondensing the above-mentioned polyhydroxy alcohol component and polycarboxylic acid component, is preferably used; and more preferably, the polyester resin is obtained by using a bisphenol A alkylene oxide adduct as a main component serving as the polyhydroxy alcohol component, with at least one component selected from the group consisting of only terephthalic acid, fumaric acid, dodecenyl succinic acid and benzene tricarboxylic acid being used as a main component serving as the polycarboxylic acid component.

With respect to the second polyester-based resin, a polyester resin, obtained by polycondensing the above-mentioned polyhydroxy alcohol component and polycarboxylic acid component, is preferably used; and more preferably, the polyester resin is obtained by using a bisphenol A alkylene oxide adduct as a main component serving as the polyhydroxy alcohol component, with a trihydric or more carboxylic acid component, that is, in particular, benzene tricarboxylic acid and at least one component selected from the group consisting of terephthalic acid, fumaric acid, and dodecenyl succinic acid being used as main components serving as the polycarboxylic acid components.

The weight ratio of the first polyester-based resin and the second polyester-based resin is preferably set in the range of 9:1 to 7:3, more preferably, 9:1 to 8:2.

With respect to the first wax, those waxes, which have a difference (X-Y) between the maximum peak temperature (X; ° C.) in the differential thermal curve in the wax and Tg (Y; ° C.) of the above-mentioned binder resin is set in the range of −5 to +10° C., preferably, −2 to +6° C., more preferably, −2 to +2° C., are preferably used. Most preferably, the first wax in which X and Y are equal to each other is used. The application of the first wax of this type in which the glass transition point of the binder resin and the maximum peak temperature in the differential thermal curve that are set to virtually the same level makes it possible to sufficiently fuse toner even when energy dissipation to the surroundings is comparatively great or when the fixing energy of a fixing system itself is comparatively small. When the above-mentioned difference (X-Y) exceeds 10° C., the toner fixing property deteriorates, causing degradation in the fixing intensity and smearing preventive property of an image. When the above-mentioned difference (X-Y) is smaller than −5° C., the image quality deteriorates, making it difficult to reproduce dots and fine lines or causing fogging. The heat resistance also deteriorates seriously.

The maximum peak temperatures in the differential thermal curve corresponds to a temperature at which the greatest maximum peak appears in a curve obtained by differential scanning calorimetry measurements (DSC), that is, a so-called melting point.

In the present invention, with respect to the "maximum peak temperature in the differential thermal curve", a differential scanning calorimeter (DSC-200: made by Seiko Instruments Inc.) is used, and values, read from curves obtained by the following measuring methods, are used. However, the measurements are not necessarily carried out by the above-mentioned device, and any device may be used as long as it provides curves from which maximum peaks in the differential thermal curve can be recognized.

(Measuring Methods)

A differential scanning calorimeter was used in which: 10 mg of a sample to be measured was precisely weighed, and this was put into an aluminum pan, while alumina was put into an aluminum pan so as to be used as reference, and was heated to 200° C. from normal temperature at a temperature-rise rate of 30° C./min, and this was then cooled, and subjected to measurements in the range of 20° C. to 120° C. at a temperature-rise rate of 10° C./min; thus, during this temperature-rise process, maximum peak temperatures in the range of 30° C. to 90° C. were found.

The first wax preferably has a melting point in the range of 55 to 75° C., more preferably, 60 to 65° C.

The kinds of the first wax are not particularly limited, as long as it has the above-mentioned melting point in association with Tg of the binder resin. Specific examples thereof include known waxes, that is, polyolefin waxes such as polyethylene, polypropylene and ethylene-propylene copolymer, synthetic ester waxes such as fatty acid esters and montan-based esters, carnauba wax, rice wax, sazol wax, Fischer-Tropsch wax, candelilla wax, hydrogenated jojoba oil wax, and paraffin wax; and one kind or two kinds or more of these may be selected and used.

Among the above-mentioned specific examples, from the viewpoint of further improving the fixing property and of providing a sharp melting property with low viscosity, fatty acid ester waxes are preferably used as the first wax.

The fatty acid ester wax is obtained through a polycondensing reaction between a straight-chain saturated monocarboxylic acid and a straight-chain saturated monohydric alcohol or a polyhydroxy alcohol, in particular, dihydric to hexahydric alcohol, and those fatty acid ester waxes having a sharp melting property are more preferably used. By allowing the toner to contain such a fatty acid ester wax, it becomes possible to effectively achieve both of the anti-blocking property and fixing property, even in the case when a wax having virtually the same melting point as the resin is used.

In order to obtain a fatty acid ester wax having a sharp melting property, the following straight-chain saturated monocarboxylic acid, straight-chain saturated monohydric alcohol and straight-chain saturated polyhydroxy alcohol are effectively used.

With respect to the straight-chain saturated monocarboxylic acid, one or more kinds of compounds selected from the group consisting of straight-chain saturated monocarboxylic acids having carbon atoms of 14 to 30 are used. When two or more kinds of compounds are used as the straight-chain saturated monocarboxylic acid, the amount of one of the components is set to not less than 60 weight % with respect to the total amount of the straight-chain saturated monocarboxylic acid. Preferable specific examples of the straight-chain saturated monocarboxylic acid include: myristic acid, palmitic acid, stearic acid, arachic acid, behenic acid, lignoceric acid, cerotic acid, montan acid and melissic acid.

With respect to the straight-chain saturated monohydric alcohol, one or more kinds of compounds selected from the group consisting of straight-chain saturated monohydric alcohols having carbon atoms of 2 to 30 are used. When two or more kinds of compounds are used as the straight-chain saturated monohydric alcohol, the amount of one of the components is set to not less than 80 weight % with respect to the total amount of the straight-chain saturated monohydric alcohol. Preferable specific examples of the straight-chain saturated monohydric alcohol include: stearyl alcohol, myristyl alcohol, cetyl alcohol, arachyl alcohol, behenyl alcohol, tetracosanol, hexacosanol, octacosanol and traiacontanol.

With respect to the straight-chain saturated polyhydroxy alcohol, one or more kinds of compounds selected from the group consisting of straight-chain saturated dihydric to hexahydric alcohols having carbon atoms of 2 to 30 are used. When two or more kinds of compounds are used as the straight-chain saturated polyhydroxy alcohol, the amount of one of the components is set to not less than 80 weight % with respect to the total amount of the straight-chain saturated polyhydroxy alcohol. Preferable specific examples of the straight-chain saturated polyhydroxy alcohol include: glycerin, dipentaerythritol and pentaerythritol.

With respect to commercial products that are used as the first wax, examples thereof include Candelilla Wax Refine made by Nippon Steel Chemical Co., Ltd. (melting-point: 67° C.), Candelilla Wax H Powder made by Mitsuba Trading Co., Ltd. (melting-point: 67° C.), hydrogenated jojoba oil M1 (melting-point: 72° C.), UNILIN 350 (melting-point: 68° C.) made by Toyo-Petrolite Co., Ltd., WEP-4 (melting-point: 71° C.), and WEP-2, (melting-point: 71° C.) made by NOF Corporation, and Rikemal VT-50 (melting-point: 70° C.), Rikemal B-150 (melting-point; 70° C.) and RIKESTER SL-02 (melting-point; 67° C.) made by Riken Vitamin Co., Ltd.

With respect to the second wax, those waxes exemplified as the first wax may be used, and among these, in particular, polyolefin-based wax is preferably used. The non-contact heat fixing process exerts only a weaker pressing force onto paper in comparison with the contact heat fixing process such as a heat roll fixing process, causing degradation in the surface smoothing property in an image and the resulting reduction in the smearing preventive property; however, the addition of the polyolefin-based wax improves the surface smoothing property in a toner image after the non-contact heat fixing process, thereby improving the smearing preventive property remarkably. In comparison with other wax components, the polyolefin-based wax has very little volatile components that volatilize at the time of a non-contact heat fixing process; therefore, it is also superior in odor-preventive property.

With respect to the polyolefin-based wax, those waxes that have a sharp melting property and a melting property with a small heat-absorbing peak are preferably used. Those polyolefin-based waxes are swiftly fused in a toner even in the case of a comparatively small fixing energy at the time of a non-contact heat-fixing process, with the result that the toner can also be swiftly fused sufficiently. The addition of those polyolefin-based waxes makes it possible to exert a superior fixing property.

With respect to the kind of the polyolefin-based wax, not particularly limited as long as it is formed by polymerizing an olefin-based monomer, in particular, homopolymer and copolymer waxes of ethylene and/or propylene are preferably used in the present invention. These polyolefin-based waxes of polymerization type, separation type and modified type may be applied; and those of polymerization type are preferably used in an attempt to apply a polyolefin-based wax having a sharp melting property and a melting property with a small heat-absorbing peak. Those of the polymerization type having a high density are most preferably used, in an attempt to prevent filming.

The polymerization-type polyolefin-based wax can be prepared by a metallocene method. The metallocene method is also superior in that it achieves a narrower molecular weight distribution, obtains a more even comonomer, and provides a lower melting point and a higher catalyst yield, in comparison with Zielger method.

The melting point of the second wax is preferably set to 80 to 150° C., more preferably, 90 to 130° C.

With respect to commercial products of the polyolefin-based wax serving as the second wax, for example, polyethylene waxes, such as 800P (made by Mitsui Chemicals Inc.,), 2203A (made by Mitsui Chemicals Inc.), 4202E (made by Mitsui Chemicals Inc.) and PE190 (made by Clariant K. K.), are available.

The total content of the first and second waxes is preferably set to 0.5 to 5 parts by weight, more preferably, 2 to 4 parts by weight, with respect to 100 parts by weights of the binder resin, in order to obtain effects of the addition without causing problems such as filming. In the present invention, besides the first and second waxes, another wax may be contained therein, and in this case, the total content thereof is properly set in the above-mentioned range.

In the present invention, the weight ratio of the first wax and the second wax is set in the range of 3:1 to 7:1, more preferably, 4:1 to 6:1. The ratio is set in this manner so that it becomes possible to achieve both of superior fixing property (fixing strength and smearing preventive property) and image quality (color reproducibility, dot reproducibility, fine-line reproducibility, fogging preventive property). When the ratio of the first wax is too big or too small, it is not possible to obtain desired fixing property, causing a reduction in the fixing strength and a higher possibility of smearing. When the ratio of the first wax is too small, it is not possible to obtain desired image quality, and in particular, it becomes difficult to reproduce dots and fine lines, resulting in a higher possibility of fogging.

With respect to the infrared absorbing agents (IR absorbing agents) to be used in the present invention, known infrared absorbing agents may be used; and examples thereof include: cyanine compounds, merocyanine compounds, benzene-thiol-based metal complexes, mercaptophenol-based metal complexes, aromatic-diamine-based metal complexes, diimmonium compounds, aluminum compounds, nickel complex compounds, phthalocyanine-based compounds, anthraquinone-based compounds and naphthalocyanine-based compounds. Specific examples include: metal-complex-based infrared absorbing agents (SIR-130, SIR-132: made by Mitsui Chemicals Inc.), bis(dithiobenzyl) nickel (MIR-101: Midori Kagaku Co., Ltd.), bis[1,2-bis(p-methoxyphenyl)-1,2-ethylenedithiolate]nickel (MIR-102: made by Midori Kagaku Co., Ltd.), tetra-n-butylammoniumbis(cis-1,2-diphenyl-1,2-ethylenedithiolate)nickel (MIR-1011: made by Midori Kagaku Co., Ltd.), tetra-n-butylammoniumbis[1,2-bis(p-methoxyphenyl)-1,2-ethylenedithiolate]nickel (MIR-1021: made by Midori Kagaku Co., Ltd.), bis(4-tert-1,2-butyl-1,2-dithiophenolate) nickel-tetra-n-butyl ammonium (BBDT-NI: made by Sumitomo Seika Chemicals Co., Ltd.), cyanine-based infrared absorbing agents (IRF-106, IRF-107: made by Fuji Photo Film Co., Ltd.), inorganic salt-based infrared absorbing agent (NIR-AMI: made by Teikoku Chemistry Industry, Inc.), immonium compounds (CIR-1080, CIR-1081: made by JAPAN CARLIT CO., LTD.), aminium compounds (CIR-960, CIR-961: made by JAPAN CARLET CO., LTD.), anthraquinone-based compounds (IR-750: made by Nippon Kayaku Co., Ltd.), aminium-based compounds (IRG-102, IRG-003: made by Nippon Kayaku Co., Ltd.), polymethine-based compound (IR-820B, made by Nippon Kayaku Co., Ltd.), diimmonium compounds (IRG-022, IRG-023: made by Nippon Kayaku Co., Ltd.), diamine compounds (CY-2, CY-4, CY-9: made by Nippon Kayaku Co., Ltd.) and soluble phthalocyanine (TX-305A: made by NIPPON SHOKUBAI Co., Ltd.). In the present invention, from the viewpoint of fixing property, a cyanine-based compound and an aminium-based compound are preferably used in combination.

In the present invention, the IR absorbing agent may be used alone, or two more kinds thereof may be used in combination. In general, there are various IR absorbing agents ranging from those having light color tones to those having deep color tones in a wavelength range of visible light, and it has been known that even in the case of the application of those having a light color tone, addition of a slight amount of such an IR absorbing agent greatly changes the color reproducibility in color toner. Therefore, in the present invention, in order to reduce influences to the color tone of a fixed image and also to control the color reproducibility, it is more preferable to use two kinds or more IR absorbing agents having different color tones in combination and to adjust the amounts of use thereof so as to control the color reproducibility, rather than to use the above-mentioned IR absorbing agent alone. From the viewpoint of simultaneously improving the fixing property, it is more preferable to use a cyanine-based compound and an aminium-based compound having different color tones in combination.

In the present invention, IR absorbing agents of a light color-suppressing type may be used alone or in combination. In particular, when an emphasis is put on the color reproducibility, the upper limit of amount of addition tends to be limited in normal IR absorbing agents. In contrast, the reduction of the IR absorbing agent tends to cause degradation in the fixing property. In an attempt to improve the fixing property while maintaining the color reproducibility at a high level, dyes of a light color-suppressing type may be preferably used as the IR absorbing agent with respect to the composition of the present invention. These materials serve as an IR absorbing agent at the time of a fixing process, and also suppresses its own color by light, thereby eliminating influences from the color of the IR absorbing agent itself and the subsequent degradation in the color reproducibility of a final image. The "light" includes ultraviolet rays, visible rays, infrared rays. Accordingly, as such a color-suppressing type is used as an IR absorbing agent, the reproducibility of color images is not deteriorated and excellent color reproducibility becomes possible even though the addition amount is increased when necessary. It also becomes possible to decrease energy required at the time of non-contact heat fixing.

In the present invention, with respect to the IR absorbing agent of a light color-suppressing type that is preferably applicable, the following light-color-suppressing-type dye, which is composed of an ion pair of an organic boron anion and a cationic organic dye, and represented by the following formula (1), is proposed.

Formula (1): $(R)_4B^-$ (In the formula, R represents a branched-chain or straight-chain substituted or non-substituted alkyl group, a substituted or non-substituted alkenyl group, a substituted or non-substituted alkynyl group, a substituted or non-substituted alicyclic group, a substituted or non-substituted aryl group, a substituted or non-substituted aralkyl group, or a substituted or non-substituted heterocyclic group, and these may be the same or different from each other, or may mutually form rings).

Specific examples of the organic boron anion represented by the general formula (1) includes: methyltriphenyl borate, ethyltriphenyl borate, n-butyltriphenyl borate, n-octyltriphenyl borate, n-dodecyltriphenyl borate, methyltri(p-tolyl) borate, ethyltri(p-tolyl) borate, n-butyl(p-tolyl) borate, n-octyl(p-tolyl) borate, n-dodecyl(p-tolyl) borate, methyltri(p-anicyl) borate, ethyltri(p-anicyl) borate, n-butyl(p-anicyl) borate, n-octyl(p-anicyl)borate, n-dodecyl(p-anicyl) borate, dimethyldiphenyl brate, diethyldiphenyl borate, di(n-butyl) diphenyl borate, di(n-octyl)diphenyl borate, di(n-dodecyl) diphenyl borate, dimethyldi(p-tolyl) borate, diethyldi(p-tolyl) borate, di(n-butyl)di(p-tolyl) borate, di(n-octyl)di(p-tolyl) borate, di(n-dodecyl)di(p-tolyl) borate, dimethyldi(p-anicyl) borate, diethyldi(p-anicyl) borate, di(n-butyl)di-(p-anicyl) borate, di(n-octyl)di(p-anicyl) borate, di(n-dodecyl) di(p-anicyl) borate, tetraphenyl borate, tetra(p-anicyl) borate, tetra(p-tolyl) borate, triphenylnaphthyl borate, tri(p-tolyl)naphthyl borate, tetra(n-butyl) borate, tri(n-butyl) (triphenylsilyl) borate, tri(n-butyl)(tridimethylphenylsilyl) borate, n-octyldiphenyl (di-n-butylphenylsilyl) borate and dimethylphenyl(trimethylsilyl) borate; and one kind or two or more kinds of these may be used, and the present invention is not intended to be limited by these.

As the cationic organic dye, the above-mentioned cyanine compounds, aminium compounds, diimmonium compounds and the like can be used.

In order to enhance a color-suppressing function of the light color-suppressing type IR absorbing agent much more, it is preferable to use a color-suppressing agent together. As the color-suppressing agent, an ion pair of the organic boron anion represented by the above formula (1) and a cation can be used. As the cation, quaternary ammonium cation, quaternary pyridinium cation, quaternary quinolinium cation or phosphonium cation can be used. Specific examples include: tetramethylammonium, tetraethylammonium tetra-n-butylammonium, tetra-n-octylammonium, tetra-n-dodecylammonium, trimethylhydrogenammonium, triethylhydrogenammonium, tri-n-butylhydrogenammonium, tri-n-octylhydrogenammonium, tetrahydrogenammonium, methylpyridinium, ethylpyridinium, n-butylpyridinium, n-octylpyridinium, n-dodecylpyridinium, methylquinolinium, ethylquinolinium, n-butylquinolinium, n-octylquinolinium, n-dodecylquinolinium. tetramethylphosphonium, tetraethylphosphonium, tetra-n-butylphosphonium, tetra-n-octylphosphonium, tetra-n-dodecylphosphonium, tetraphenylphosphonium and tetraanisylphosphonium ion and the like. The organic boron anion and the cation can be used in combination. A preferable combinations include: n-butyltriphenyl borate and tetrabutylammonium, n-butyltriphenyl borate and tetramethylammonium, dimethyldiphenyl borate and tetrabutylammonium, dibutyldiphenyl borate and tetrabutylammonium. These color-suppressing agents can be used alone or as a mixture of two or more kinds thereof. From the viewpoint of obtaining such an effect as to improve color-suppressing properties without having a harmful influence on an image-quality, it is preferable that the total amount of the color-suppressing agent is within the range of 50 to 300 parts by weight with respect to 100 parts by weight of the light color-suppressing type IR absorbing agent.

The amount of use of the IR absorbing agent is preferably set to 0.01 to 5 parts by weight, more preferably, 0.01 to 3 parts by weight, with respect to 100 parts by weight of the binder resin. In other words, the amount of use of less than 0.01 parts by weight tends to cause difficulty in providing sufficient fixing property. Although no problems are caused with respect to the fixing property, the amount of use exceeding 5 parts of weight causes not only disadvantages in economic efficiency, but also difficult in controlling the color tone of the toner as described earlier, resulting in degradation in the color tone of a toner. In the case when two or more kinds of IR absorbing agents are used, the total amount of those agents is appropriately set in the above-mentioned range.

In the case when two kinds of IR absorbing agents having different color tones, in particular, a cyanine-based compound and an aminium-based compound having different color tones, are used from the viewpoints of toner fixing property, economical efficiency and color tone, it is most preferable to respectively set the amounts thereof in the range of 0.1 to 1.5 parts by weight with respect to 100 parts by weight of the binder resin.

In particular, in the case when a cyanine-based compound and an aminium-based compound are used in combination, the ratio of the amounts thereof are appropriately determined in the range of 2:1 to 1:3 for the respective colors. More specifically, in the case of magenta toner, the ratio is preferably set in the range of 1:1 to 1:2. In the case of cyan toner, the ratio is preferably set in the range of 1:1 to 2:1. In the case of yellow toner, the ratio is preferably set in the range of 1:1 to 1:2.

In the present invention, known pigments and dyes are used as colorants. Examples thereof include: carbon black, aniline blue, Chalcooil Blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1, C.I. Pigment Blue 15:3, etc. The content of these colorants is preferably set in the range of 2 to 7 parts by weight with respect to 100 parts by weight of the binder resin.

With respect to the black toner, in addition to various carbon blacks, activated carbon and titanium black, one portion or the entire portion of the colorant may be replaced with a magnetic substance. Examples of such a magnetic substance include know magnetic fine particles such as ferrite, magnetite and iron. In an attempt to obtain an appropriate dispersion property upon manufacturing, the average particle size of the magnetic particles in preferably set to not more than 1 μm, more preferably, not more than 0.5 μm.

The toner of the present invention may contain additives, such as a charge-controlling agent, on demand.

With respect to the charge-controlling agent, examples thereof includes metal-containing dyes such as a fluorine-based surfactant, a salicylic acid metal complex and an azo-based metal compound, a polymeric acid such as a copolymer containing maleic acid as its monomer component, quaternary ammonium salts, azine-based dyes such as Nigrosine, and carbon black.

In the toner of the present invention, the state of presence of each of the components is not particularly limited. In particular, the IR absorbing agent may be contained in the toner particles made from at least a binder resin, or may be fixed and fused on the outer surface of the toner particles. Alternatively, one portion thereof may be internally contained, with the rest portion thereof being fixed and fused on the outer surface of the toner particles. From the viewpoint of the sufficiently fusing each toner particle so as to improve the fixing property, it is more preferably to contain the agent in the toner particle.

The toner particles of the present invention may be prepared in accordance with a pulverizing method, or wet granulation methods such as an emulsion polymerization method, an emulsion polymerizing coagulation method, an emulsion dispersion method, emulsion dispersing coagulation method, an emulsion polymerization method, a suspension polymerization method and suspension granulation method.

In the pulverizing method, after a binder resin, a colorant and an IR absorbing agent as well as other additives have been mixed, the mixture is melt-kneaded, and cooled to obtain a kneaded matter. Then, the kneaded matter is pulverized and classified to obtain a toner particles.

In the emulsion polymerizing coagulation method, a polymerizable composition containing a polymerizable monomer capable of forming a binder resin, such as the raw-material monomer for the vinyl-based resin and the like, is dispersed in an aqueous medium containing a polymerization initiator and is emulsion-polymerized to obtain binding resin particles. Thereafter, the resin particles and the like are aggregated/fused and, filtered, washed and dried to obtain toner particles. A colorant and an IR absorbing agent may be aggregated/fused with the resin particles, or may be preliminarily contained in the polymerizable composition or the aqueous medium in an independent manner respectively. It is preferably that both of the colorant and the IR absorbing agent are aggregated/fused with the resin particles. A first wax and a second wax may be aggregated/fused with the resin particles, or may be preliminarily contained in the polymerizable composition or the aqueous medium in an independent manner respectively. It is preferable that both of the first wax and the second wax are preliminarily contained in the polymerizable composition. The emulsion-polymerization may be carried out in multiple stages to obtain composite type binding resin particles. In other words, the polymerizable composition is emulsion-polymerized in an aqueous medium and after the resulting resin fine particle dispersion has been mixed with an aqueous medium separately prepared, a polymerizable composition, prepared in a separated manner, is mixed and stirred therewith to carry out an emulsion-polymerizing process. These operations may be carried out repeatedly. In the present specification, the term "aggregation" is used under the concept that the plural resin particles and the like simply adhere to each other. So-called hetero aggregation particles (group) are formed through "aggregation" in which, although the constituent particles are made in contact with each other, no joint is formed through melting among the resin particles and the like. The particle group that is formed through such "aggregation" is simply referred to as "aggregated particles". The term "fusion" is used under the concept that a joint is formed through melting process of the resin particle and the like in at least one portion on the interface between the respective constituent particles in the aggregated particles to form one particle as an application and handling unit. A group of particles that are subjected to such "fusion" are referred to as "fused particles". The term "aggregated/fused" means that the aggregation and the fusion occur at the same time or stepwise, or an action causing the aggregation and the fusion to occur at the same time or stepwise.

In the emulsion dispersing method, a binder resin is dissolved in an organic solvent, such as toluene, ethyl acetate and the like, and a colorant, an IR absorbing agent, a first wax and a second wax as well as other additives are dispersed or dissolved in the resulting resin solution. Thereafter, the obtained resin solution is emulsion-dispersed in an aqueous medium and the solvent component is removed. The resulting dispersion is filtered, washed and dried to obtain toner particles.

In the emulsion dispersing coagulation method, a binder resin is dissolved in an organic solvent, such as toluene, ethyl acetate and the like, and the resulting resin solution is emulsion-dispersed in an aqueous medium. From the resulting dispersion the solvent component is removed to obtain binding resin particles. Thereafter, the resin particles and the like are aggregated/fused and filtered, washed and dried to obtain toner particles. A colorant, an IR absorbing agent, a first wax and a second wax may be aggregated/fused with the resin particles, or may be preliminarily contained in the resin solution in an independent manner respectively.

In the case when, among the above-mentioned preparation methods of toner particles, the methods in which a binder resin is directly used, such as the pulverizing method, the emulsion dispersing method, the emulsion dispersing coagulation method and the like, are employed, Tg and Tm of the binder resin may respectively be set within the above-mentioned range as the Tg and Tm of the used binder resin.

In the case when the wet polymerization methods in which a binder resin is not directly used, such as the emulsion polymerizing coagulation method, the emulsion polymerizing method, the suspension polymerization method and the like, are employed, Tg and Tm of the binder resin may respectively be set within the above-mentioned range as the Tg and Tm of the toner particles that are obtained by the same preparation method as the wet polymerization methods except that a colorant, an IR absorbing agent, a first wax and a second wax are not used. In particular, when the wet polymerization methods are employed, the content and the use amount of the colorant, the IR absorbing agent, the first wax and the second wax may respectively be set within the above-mentioned range as the values with respect to 100 parts by weight of the polymerizable monomer for forming the binder resin in the toner particle.

It is preferable to add various organic/inorganic fine particles to the toner particles as fluidity-adjusting agents in the present invention. Examples of the inorganic fine particles include various carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam, various nitrides such as boron nitride, titanium nitride and zirconium nitride, bromide such as zirconium bromide, various oxides, such as titanium oxide, calcium oxide, magnesium oxide, zinc oxide, copper oxide, aluminium oxide, silica and colloidal silica, various titanic acid compounds, such as calcium titanate, magnesium titanate and strontium titanate, sulfides such as molybdenum disulfide, fluorides such as magnesium fluoride and carbon fluoride, various metal soaps, such as aluminum stearate, calcium stearate, zinc stearate and magnesium stearate, and various nonmagnetic inorganic fine particles such as talc and bentonite. These materials may be used alone or in combination. In particular, in the case of the application of inorganic fine particles such as silica, titanium oxide, alumina and zinc oxide, it is preferable to preliminarily carry out a surface treatment by a known method using a conventionally used hydrophobic-property applying agent, such as a silane coupling agent, a titanate coupling agent, silicone oil and silicone varnish, or using a treatment agent, such as a fluorine-based silane coupling agent or fluorine-based silicone oil, a coupling agent having an amino group and a quaternary aluminum salt group, and a modified silicone oil.

Referring to an image-forming apparatus shown in FIG. 1 using the method of the present invention, the following description will discuss an image-forming method which includes a non-contact heating fixing method to which the non-contact heat-fixing color toner of the present invention is desirably applied.

In the full-color image-forming apparatus shown in FIG. 1, a recording medium 1, which is wound into a roll shape, is fed by respective rollers 2, and on one surface side of the recording medium 1 fed in this manner, a first image-forming unit 10Bk that supplies black toner to the recording medium 1, a second image-forming unit 10C that supplies cyan toner to the recording medium 1, a third image-forming unit 10M that supplies magenta toner to the recording medium 1 and a fourth image-forming unit 10Y that supplies yellow toner to the recording medium 1 are placed in this order from the upstream side of the recording medium 1 toward the downstream side thereof.

Thus, the first to fourth image-forming units 10Bk, 10C, 10M and 10Y supply the respective toners to appropriate places so that a full-color toner image is continuously formed on the one surface side of the recording medium 1 that is fed by the feeding rollers 2 as described above.

In this manner, the recording medium 1 on which the full-color toner image has been continuously formed on its one surface side is directed to a flash fixing device 20 provided with a flash lamp by using a feeding roller 2 so that the full-color toner image formed on the one surface side of the recording medium 1 is irradiated with light from this flash fixing device 20 so that the full-color toner image is fixed on the recording medium 1 by this light energy. For example, the flash lamp may be a xenon lamp, a halogen lamp or the like.

In the case when the above-mentioned toner of the present invention is applied as toners in the first to fourth image-forming units 10Bk, 10C, 10M and 10Y, in particular, as toners in the second to fifth image-forming units 10C, 10M and 10Y, the above-mentioned flash fixing device 20 is allowed to sufficiently fix the full-color toner image without causing any problem with the smearing preventive property, even in the case of fixing the full-color toner image by superposing the respective toners on the recording medium 1.

Upon fixing the full-color toner image on the recording medium 1 by using the flash fixing device 20 as described above, the light-emitting energy of the flash lamp can be set in the range of 1.0 to 3.5 J/cm$^2$, more preferably, 1.0 to 3.0 J/cm$^2$, most preferably, 1.5 to 2.5 J/cm$^2$. Even with such low energy, the toner image formed by the full-color toner of the present invention can be sufficiently fixed on the recording medium 1.

EXAMPLES

(Production Example of Polyester Resin)

To a four-neck flask provided with a thermometer, a stainless stirring stick, a dropping-type condenser and a nitrogen gas directing tube were loaded an alcohol component and an acid component, which were adjusted to a mole ratio as shown in Table 1, together with a polymerization initiator (dibutyltinoxide). This was allowed to react in a mantle heater by heating at 220° C. while being stirred under a nitrogen gas flow. Here, the progress of the reaction was traced by measuring its acid value. At the time of reaching a predetermined acid value, the reaction was completed, and this was cooled to room temperature; thus, polyester resins H1, H2, L1 and L2 were obtained. Each of polyester resins was coarsely pulverized into not more than 1 mm, and was used to manufacture toners shown below. The resulting polyester resins had physical properties, that is, glass transition temperature (Tg), softening point (Tm), acid value, hydroxide value and THF insoluble components, shown in Table 1.

TABLE 1

| | Alcohol component | | Acid component | | | | Physical properties | | | | |
|---|---|---|---|---|---|---|---|---|---|---|---|
| | BPA-PO | BPA-EO | TPA | TMA | DSA | FA | Tg (° C.) | Tm (° C.) | Acid value (KOHmg/g) | Hydroxide value (KOHmg/g) | THF Insoluble component (%) |
| Resin L1 | 570 | 330 | 100 | 0 | 0 | 100 | 60.1 | 99.2 | 15.9 | 22.2 | — |
| Resin H1 | 350 | 400 | 150 | 100 | 50 | 50 | 65.1 | 135.3 | 14.6 | 15.6 | 18.1 |
| Resin L2 | 900 | 50 | 50 | 0 | 0 | 0 | 64.2 | 106.8 | 30.6 | 20.5 | — |
| Resin H2 | 375 | 375 | 200 | 50 | 50 | 50 | 60.2 | 119.6 | 25.3 | 14.7 | 0.9 |

In this Table, BPA-BO represents polyoxypropylene (2,2)-2,2-bis(4-hydroxyphenyl) propane, BPA-EO represents polyoxyethylene (2,0)-2,2-bis(4-hydroxyphenyl) propane, TPA represents terephthalic acid, TMA represents trimellitic acid, DSA represents isododecenyl succinic anhydride and FA represents fumaric acid.

In the following examples, a material prepared by mixing resin H1 and resin L1 at a weight ratio of 15:85 was used as polyester resin A1. The Tg of polyester resin A1 was 62° C., and the Tm thereof was 105° C.

A material prepared by mixing resin H2 and resin L1 at a weight ratio of 15:85 was used as polyester resin A2. The Tg of polyester resin A2 was 60° C., and the Tm thereof was 102° C.

A material prepared by mixing resin H1 and resin L2 at a weight ratio of 15:85 was used as polyester resin A3. The Tg of polyester resin A3 was 65° C., and the Tm thereof was 109° C.

(Production Example of First Wax)

Ester wax A

To a four-neck flask were added 100 g of glycerin (about 1 mole) serving as alcohol and 900 g of stearic acid (about 3 moles) serving as carboxylic acid, and this new allowed to react at normal pressure for 15 hours under a nitrogen gas flow while distilling the reaction water off at 220° C. The amount of the resulting esterified coarse product was approximately 900 g. To 900 g of the esterified coarse product were added 190 g of toluene and 90 g of ethanol (20 parts by weight of hydrocarbon solvent and 10 parts by weight of separation-use alcohol solvent with respect to 100 parts by weight of the esterified coarse product), and to this was further added a 8% aqueous solution of sodium hydroxide and stirred for 30 minutes at 70° C. Thereafter, this was allowed to stand still for 30 minutes and the water-layer portion was removed to complete the deoxidizing process. Next, 20 parts by weight of ion exchange water was added to 100 parts by weight of the esterified coarse product thus used, and after having been stirred for 30 minutes at 70° C., this was allowed to stand still for 30 minutes so that the water layer portion was separated and removed. Washing processes were repeated until the pH of the waste water had become neutral, and with respect to the remaining ester layer, the solvent was distilled off at 180° C. under reduced pressure of 1 kPa, and filtered to obtain an ester wax A having a melting point of 62° C.

Ester waxes B to F

The same processes as those in the manufacturing method of wax A were carried out except that an acid component, an alcohol component, a hydrocarbon-based solvent, an alcohol-based solvent and an alkali aqueous solution, shown in Table 2, were used at the respective amounts as shown in Table 2 so that ester waxes B to F were obtained.

TABLE 2

| | Acid component | | Alcohol component | | | Hydrocarbon solvent | | Alcoholic solvent | | | Melting |
|---|---|---|---|---|---|---|---|---|---|---|---|
| | Weight ratio | Molar ratio | Weight ratio | Molar ratio | Esterification | g | parts by weight | g | parts by weight | Alkaline solution (g) | point (° C.) |
| Ester Wax A | Stearic acid | | Glycerine | | 900 g | Toluene | | Ethanol | | 8% NaOH aqueous solution | 62 |
| | 900 g | 3 mole | 100 g | 1.1 mole | | 190 g | 20 | 90 g | 10 | 90 g | |

TABLE 2-continued

| | Acid component | | Alcohol component | | | Hydrocarbon solvent | | Alcoholic solvent | | | Melting |
|---|---|---|---|---|---|---|---|---|---|---|---|
| | Weight ratio | Molar ratio | Weight ratio | Molar ratio | Esterification | g | parts by weight | g | parts by weight | Alkaline solution (g) | point (° C.) |
| Ester Wax B | Stearic acid | | Steryl alcohol | | 800 g | Cyclohexane | | Ispropanol | | 8% NaOH aqueous solution | 60 |
| | 430 g | 1.5 mole | 400 g | 1.5 mole | | 200 g | 25 | 40 g | 5 | 60 g | |
| Ester Wax C | Palmitic acid | | Dipentaerythritol | | 850 g | Toluene | | Ethanol | | 10% NaOH aqueous solution | 72 |
| | 800 g | 3 mole | 100 g | 0.7 mole | | 170 g | 20 | 50 g | 5 | 130 g | |
| Ester Wax D | Myristic acid | | Dipentaerythritol | | 600 g | Toluene | | n-propanol | | 8% NaOH aqueous solution | 68 |
| | 570 g | 2.5 mole | 100 g | 0.4 mole | | 190 g | 30 | 30 g | 5 | 100 g | |
| Ester Wax E | Behenic acid | | Pentaerythritol | | 1000 g | Xylene | | Ethanol | | 10% NaOH aqueous solution | 84 |
| | 1050 g | 3.1 mole | 100 g | 0.7 mole | | 160 g | 15 | 40 g | 4 | 120 g | |
| Ester Wax F | Stearic acid | | Stearyl alcohol | | 800 g | — | | — | | — | 56 |
| | 430 g | 1.5 mole | 400 g | 1.5 mole | | — | — | — | — | | |

(Production Example of Second Wax)

Polyolefin copolymer wax A

To a reactor were measured and charged 1000 g of propane, 250 g of propene, hydrogen of 0.5 bar and ethylene of 7 bar at 30° C.: Simultaneously with these processes, in order to prepare a catalyst, 10 mg of bis-n-butylcyclopentadienyl zirconium dichloride was dissolved in a methylaminohexane solution having a concentration of 10% by weight in 5 $cm^3$ of toluene, and this was allowed to stand still for 15 minutes to be preliminarily activated. This reactor was heated to 70° C., and stirred at 100 rpm. After a lapse of 20 minutes, the catalyst that had been preliminarily activated was added thereto through a pressure controllable valve so that a polymerizing process was initiated at 250 rpm. This was cooled so that the polymerization temperature was adjusted to 70° C., and components were measured and further added thereto so that the composition in the gaseous phase was maintained constant. After one hour of the polymerization time, isopropanol was added thereto to stop the reaction, and the reactor was released to air. The resulting product was pressure-reduced and dried to obtain an ethylene-propylene copolymer A having a melting point of 105° C.

Polyolefin copolymer wax B

To a reactor were measured and charged 300 g of propane, 100 g of propene, hydrogen of 1 bar and ethylene of 4.5 bar at 30° C. Simultaneously with these processes, in order to prepare a catalyst, 5 mg of bis(cyclopentadienyl) zirconium dichloride was dissolved in a methylaminohexane solution having a concentration of 10% by weight in 10 $cm^3$ of toluene, and this was allowed to stand still for 15 minutes to be preliminarily activated. This reactor was heated to 70° C., and stirred at 100 rpm. After a lapse of 20 minutes, the catalyst that had been preliminarily activated was added thereto through a pressure controllable valve so that a polymerizing process was initiated at 250 rpm. This was cooled so that the polymerization temperature was adjusted to 70° C., and components were measured and further added thereto so that the composition in the gaseous phase was maintained constant. After one hour of the polymerization time, isopropanol was added thereto to stop the reaction, and the reactor was released to air. The resulting product was pressure-reduced and dried to obtain an ethylene-propylene copolymer B having a melting point of 120° C.

(Production of IR Absorbing Agent)

Cyanine-based compound

To a solvent of 10 parts of acetic anhydride were added 2 parts of 5-methoxy-1-ethyl-3,3-dimethyl-2-methylene indoline, 1 parts of 2-chloro-1-formyl-3-hydroxymethylenecyclohexene, 1 part of tetrafluoro boric acid and 0.5 parts of sodium acetic anhydride, and after having been boiled for 1 hour, this was cooled to room temperature, and the reaction solution was suction-filtered. The reaction solution was put into 30 parts of water with ice, and the precipitated crystal was suction-filtered. The crystal was washed with 20 parts of methanol, and dried to obtain a cyanine-based compound.

Aminium-based compound

To ethyl acetate was dissolved 1.38 g of N,N,N',N'-tetracis(p-dibutylaminophenyl)-p-penylenediamine, and to this was added a solution prepared by dissolving 6 ml of acetonitrile, 0.22 g of sodium perchlorate and 1.13 g of ammonium salt of ferric complex salt of 1,3-diaminopropane tetraacetate dissolved in 6 ml of water. This was stirred for 6 hours at 30° C. The reaction mixture was washed with water, and condensed under reduced pressure, and to this was added n-heptane so that the deposited crystal was filtered and dried to obtain an aminium-based compound (green powder).

(Production of Pigment Master Batch)

Each of binder resins used in examples or comparative examples and a pigment, such as C.I. Pigment Red 57-1 (made by Fuji Shikiso K.K.), C.I. Pigment Blue 15-3 (made by Dainippon Ink & Chemicals Inc.) or C.I. Pigment Yellow 180 (made by Clariant K.K.), were loaded into a pressure kneader at a weight ratio of 7:3, and kneaded for 1 hour at 120° C. After having been cooled, this was coarsely pulverized with a hammer mill to obtain each of pigment master batches of magenta, cyan and yellow having a pigment content of 30% by weight.

(Production of Full-color Toner)

Examples 1 to 13 and Comparative Examples 1 to 6

Binder resin, first wax, second wax and IR absorbing agent, shown in Tables 3 and 4, were used at respective amounts shown in Tables 3 and 4 with respect to 100 parts by weight, and a magenta master batch virtually containing 4.0 parts by weight of pigment was used. After a mixture of these had been sufficiently mixed by a Henschel mixer, the resulting mixture was melt-kneaded by using a twin-screw extruder kneader (PCM-63 made by Ikegai Ltd.), and then cooled. The resulting kneaded matter was rolled by a cooling press, and cooled off by using a cooling belt, and then coarsely pulverized by a feather mill. Thereafter, the resulting matter was pulverized by using a mechanical pulverizing device (KTM: made by Kawasaki Heavy Industries Ltd.) to an average particle size of 10 to 12 μm, and further pulverized and coarsely classified by a jet mill (IDS: made by Nippon Pneumatic Mfg. Co., Ltd.) to an average particle size of 7 μm, and then finely pulverized and classified by a rotor-type classifier (Teeplex-type classifier 100ATP: made by Hosokawamicron Corp.) to obtain magenta toner particles having a volume-average particle size of 7.5 μm.

To 100 parts by weight of these toner particles were added 0.5 parts by weight of hydrophobic silica fine particles (H-2000: made by Wacker Co., Ltd.), 0.5 parts by weight of titanium oxide (STT30A: made by Titan Kogyo K.K.) and 1.0 part by weight of strontium titanate having an average particle size of 0.2 μm, and the mixture of these was mixed by a Henschel mixer at a peripheral speed of 40 m/sec for 5 minutes, and then filtered through a sieve of 106 μm mesh to obtain a toner.

TABLE 3

| | Binder resin | Wax | | | | | | | IR absorbing agent | |
|---|---|---|---|---|---|---|---|---|---|---|
| | | First Wax (A) | | | Second Wax (B) | | | | Addition amount (parts by weight) | |
| | PES Resin (Tg; Y) | Kind | Melting point; X | Addition amount (parts by weight) | Kind | Addition amount (parts by weight) | Wax ratio A:B | X − Y (° C.) | Cyanin based | Aminium based |
| Example 1 | A1(62° C.) | Ester A | 62° C. | 2.5 | 800P | 0.5 | 5:1 | ±0 | 0.3 | 0.5 |
| Example 2 | A1(62° C.) | Ester B | 60° C. | 2.5 | 800P | 0.5 | 5:1 | −2 | 0.3 | 0.5 |
| Example 3 | A3(65° C.) | Ester C | 72° C. | 2.5 | 800P | 0.5 | 5:1 | +7 | 0.3 | 0.5 |
| Example 4 | A1(62° C.) | Ester D | 68° C. | 2.5 | 800P | 0.5 | 5:1 | +6 | 0.3 | 0.5 |
| Example 5 | A1(62° C.) | Ester A | 62° C. | 2.0 | 800P | 0.5 | 4:1 | ±0 | 0.3 | 0.5 |
| Example 6 | A1(62° C.) | Ester A | 62° C. | 3.0 | 800P | 0.5 | 6:1 | ±0 | 0.3 | 0.5 |
| Example 7 | A1(62° C.) | Ester A | 62° C. | 2.5 | 800P | 0.75 | 3.3:1 | ±0 | 0.3 | 0.5 |
| Example 8 | A1(62° C.) | Ester A | 62° C. | 2.0 | 800P | 0.3 | 6.6:1 | ±0 | 0.3 | 0.5 |
| Example 9 | A3(65° C.) | Ester A | 62° C. | 2.5 | 800P | 0.5 | 5:1 | −3 | 0.3 | 0.5 |
| Example 10 | A2(60° C.) | Ester A | 62° C. | 2.5 | 800P | 0.5 | 5:1 | +2 | 0.3 | 0.5 |
| Example 11 | A1(62° C.) | Ester A | 62° C. | 2.5 | Copolymer A | 0.5 | 5:1 | ±0 | 0.3 | 0.5 |
| Example 12 | A1(62° C.) | Ester A | 62° C. | 2.5 | Copolymer B | 0.5 | 5:1 | ±0 | 0.3 | 0.5 |
| Example 13 | A1(62° C.) | Ester A | 62° C. | 2.5 | 2203A | 0.5 | 5:1 | ±0 | 0.3 | 0.5 |

TABLE 4

| | Binder resin | Wax | | | | | | | IR absorbing agent | |
|---|---|---|---|---|---|---|---|---|---|---|
| | | First Wax (A) | | | Second Wax (B) | | | | Addition amount (parts by weight) | |
| | PES Resin (Tg; Y) | Kind | Melting point; X | Addition amount (parts by weight) | Kind | Addition amount (parts by weight) | Wax ratio A:B | X − Y (° C.) | Cyanin based | Aminium based |
| Comparative Example 1 | A1(62° C.) | Ester E | 84° C. | 2.5 | 800P | 0.5 | 5:1 | +22 | 0.3 | 0.5 |
| Comparative Example 2 | A1(62° C.) | Ester F | 56° C. | 2.5 | 800P | 0.5 | 5:1 | −6 | 0.3 | 0.5 |
| Comparative Example 3 | A1(62° C.) | Ester A | 62° C. | 2.5 | — | — | — | ±0 | 0.3 | 0.5 |
| Comparative Example 4 | A1(62° C.) | Carnauba | 80° C. | 2.5 | 800P | 0.5 | 5:1 | +18 | 0.3 | 0.5 |
| Comparative Example 5 | A1(62° C.) | Ester A | 62° C. | 4.0 | 800P | 0.5 | 8:1 | ±0 | 0.3 | 0.5 |
| Comparative Example 6 | A1(62° C.) | Ester A | 62° C. | 1.0 | 800P | 0.5 | 2:1 | ±0 | 0.3 | 0.5 |

In the table, the amount of addition indicates a value with respect to 100 parts by weight of the binder resin.

"Carnauba" refers to carnauba wax (melting point: 80° C.).

"800P" refers to polyethylene was "800P" (made by Mitsui Chemicals Inc.)

"2203A" refers to polyethylene was "2203A" (made by Mitsui Chemicals Inc.)

(Example 14)

Production example of cyan toner

<<Colorant dispersion solution>>

| Cyan colorant dispersion solution | |
|---|---|
| Pigment C.I. Pigment Blue 15:3 | 50 parts by weight |
| Cyanine-based compound | 3.5 parts by weight |
| Aminium-based compound | 6.0 parts by weight |
| Dodecyl sulfate Na salt | 10 parts by weight |
| Ion exchange water | 200 parts by weight |

The above-mentioned components were dispersed in a sand grinder mill to obtain a cyan colorant dispersion solution having a volume-average particle size (D50) of 710 nm.

<<Preparation of Latex>>

(Preparation of latex 1HML)

(Dispersion medium 1)

| | |
|---|---|
| Sodium dodecyl sulfate | 4.05 g |
| Ion exchange water | 2500.00 g |

(1) Preparation of nucleus particles (first stage polymerization):

To a 5000 ml separable flask equipped with a stirring device, a temperature sensor, a cooling tube and a nitrogen gas directing device, the above-mentioned dispersion medium 1 was charged, and this was heated to a temperature of 80° C. in the flask, while being stirred at a stirring speed of 230 rpm under a nitrogen gas flow.

(Monomer solution 1)

| | |
|---|---|
| Styrene | 568.00 g |
| n-butyl acrylate | 164.00 g |
| Methacrylic acid | 68.00 g |
| n-octyl mercaptan | 16.51 g |

To this activator solution was added an initiator solution prepared by dissolving 9.62 g of a polymerization initiator (potassium persulfate) in 200 g of ion exchange water, and the above-mentioned monomer solution was dripped therein in 90 minutes, and this system was heated and stirred at 80° C. for 2 hours to carry out a polymerization process (first stage polymerization) to prepare a latex. This was indicated as "latex (1H)". The weight-average particle size of the latex (1H) was 68 nm.

(2) Formation of intermediate layer (second stage polymerization) Intermediate layer (Monomer solution 2)

| | |
|---|---|
| Styrene | 123.81 g |
| n-butyl acrylate | 39.51 g |
| Methacrylic acid | 12.29 g |
| n-octyl mercaptan | 0.72 g |
| Ester wax A | 65.0 g |
| Polyolefin copolymer wax A | 10.0 g |

The above-mentioned monomer solution 2 was charged into a flask equipped with stirring device, and heated and dissolved at 80° C. to prepare a monomer solution.

(Dispersion medium 2)

| | |
|---|---|
| $C_{10}H_{21}(OCH_2CH_2)_2OSO_3Na$ | 0.60 g |
| Ion exchange water | 2700.00 g |

The above-mentioned dispersion medium 2 was heated to 98° C., and to this dispersion medium, 32 g of the above-mentioned latex (1H) as expressed in terms of solid component equivalent that served as the dispersion medium of nucleus particles was added, and the resulting monomer solution 2 was then mixed and dispersed by a mechanical dispersing machine "CLEARMIX" having a circulation path (made by M Technique) for 8 hours to prepare a dispersion solution (emulsion solution) containing emulsified particles (oil droplets).

Next, to this dispersion solution (emulsion solution) was added an initiator solution prepared by dissolving 6.12 g of a polymerization initiator (potassium persulfate) in 250 ml of ion exchange water, and this system was heated and stirred at 82° C. for 12 hours to carry out a polymerization process (second stage polymerization) to prepare a latex (a dispersion solution of composite resin particles having a structure in which the surface of each of the latex (1H) particles was coated). This was indicated as "latex (1H)".

(3) Formation of outer layer (third stage polymerization) Outermost layer

To the latex (1HM) obtained as described above was added an initiator solution prepared by dissolving 8.8 g of a polymerization initiator (KPS) in 350 ml of ion exchange water, and to this were further added 350 g of styrene, 95 g of n-butyl acrylate, and 5 g of methacrylic acid under a temperature condition of 82° C., and to this activator solution was dripped a solution prepared by adding 1.0 mole % of n-octyl mercaptan to the above-mentioned monomer to be dispersed therein, in one hour. After completion of the dripping process, this was heated and stirred for 2 hours so as to carry out a polymerization process (third polymerization), and cooled to 28° C. so that a latex (a dispersion solution of a composite resin which has a center portion made from the latex (1H), the intermediate layer made from the second stage polymerization resin and the outer layer made from the third stage polymerization resin, with the second stage polymerization resin layer containing a wax) was obtained. This latex was indicated as "latex (1HML)".

<<Preparation of Toner particles>>

To a reaction container (four-neck flask) equipped with a temperature sensor, a cooling tube, a nitrogen gas directing device and a stirring device was charged and stirred 420.0 g of the latex (1HML) (as expressed in terms of solid component equivalent), 900 g of ion exchange water and 150 g of the above-mentioned cyan colorant dispersion solution. After the temperature inside the container had been adjusted to 30° C., a 5-N sodium hydroxide aqueous solution was added to this solution to adjust the pH to 8 to 10.0.

A solution, prepared by dissolving 65.0 g of magnesium chloride 6 hydrate in 1000 ml of ion exchange water, was dripped therein at 30° C. in 10 minutes, while being stirred. After having been leaf for 3 minutes, this was heated to 92° C. to form aggregated particles. In this state, the particle size of the aggregated particles was measured by "Coulter Counter TA-II", and at the time when the number-average particle size was set to 6.1 μm, an aqueous solution, prepared by dissolving 80.4 g of sodium chloride in 1000 ml of ion exchange water, was added thereto to stop the growth of the particles, and this was heated and stirred at a solution temperature of 94° C. as a maturing process so that the fusion of the particles and the phase separation of the crystallation substance were continued (maturing process). In this state, the shape of the fused particles was measured by a "FPIA-2000", and at the time when the shape coefficient had reached 0.960, this was cooled to 30° C. to stop the stirring process. The fused particles thus formed were filtered, and washed with ion exchange water at 45° C. repeatedly, and then dried by hot air at 40° C. so that cyan toner particles were obtained. The number-average particles size and the shape coefficient of the cyan toner particles were again measured, and found to be respectively 6.0 μm and 0.962.

Fused particles were formed in the same manner as described above except that wax, colorant and IR absorbing agent were not contained therein, and after these had been filtered, washed and dried, Tg thereof was measured, and found to be 62° C. Tm was 105° C.

<<Production of toner>>

To 100 parts by weight of these toner particles were added 0.5 parts by weight of hydrophobic silica fine particles (H-2000: made by Wacker Co., Ltd.), 0.5 parts by weight of titanium oxide (STT30S: made by Titan Kogyo K.K.) and 1.0 part by weight of strontium titanate having an average particle size of 0.2 μm, and the mixture of these was mixed by a 9-L Henschel mixer at a peripheral speed of 40 m/sec for 5 minutes, and then filtered through a sieve of 106 μm mesh to obtain cyan toner C1. With respect to the toner, addition of the hydrophobic silica and hydrophobic titanium oxide thereto caused no changes to the shape and particle size thereof.

(Example 15)

Production example of magenta toner

| Magenta colorant dispersion solution | |
|---|---|
| Pigment C.I. Pigment Red 122 | 80 parts by weight |
| Cyanine-based compound | 4.0 parts by weight |
| Aminium-based compound | 6.0 parts by weight |
| Dodecyl sulfate Na salt | 10 parts by weight |
| Ion exchange water | 200 parts by weight |

The above-mentioned components were dispersed in a sand grinder mill to obtain a mazenta colorant dispersion solution having a volume-average particle size (D50) of 160 nm.

Mazenta toner particles were obtained in a manner similar to Example 14, except that the above mazenta colorant dispersion solution was used and that polyolefin copolymer wax B was used instead of polyolefin copolymer wax A. The number-average particle size and shape coefficient of these magenta toner particles were again measured, and found to be 6.0 μm and 0.965 respectively.

The magenta toner particles were subjected to treatments using hydrophobic silica, hydrophobic titanium oxide and strontium titanate in the same method as Example 14 to obtain magenta toner M1.

(Example 16)

| Yellow colorant dispersion solution | |
|---|---|
| Pigment C.I. Pigment Yellow 74 | 55 parts by weight |
| Cyanine-based compound | 4.5 parts by weight |
| Aminium-based compound | 7.0 parts by weight |
| Dodecyl sulfate Na salt | 10 parts by weight |
| Ion exchange water | 200 parts by weight |

The above-mentioned components were dispersed in a sand grinder mill to obtain a yellow colorant dispersion solution having a volume-average particle size (D50) of 160 nm.

Yellow Toner particles were obtained in a manner similar to Example 14, except that the above yellow colorant dispersion solution was used and that polyolefin copolymer wax B was used instead of polyolefin copolymer wax A. The number-average particle size and shape coefficient of these yellow toner particles were again measured, and found to be 6.1 μm and 0.965 respectively.

The yellow toner particles were subjected to treatments using hydrophobic silica, hydrophobic titanium oxide and strontium titanate in the same method as Example 14 to obtain yellow toner Y1.

(Example 17)

| Black colorant dispersion solution | |
|---|---|
| Mogul L (made by Cabot Corporation) | 85 parts by weight |
| Dodecyl sulfate Na salt | 10 parts by weight |
| Ion exchange water | 200 parts by weight |

The above-mentioned components were dispersed in a sand grinder mill to obtain a black colorant dispersion solution having a volume-average particle size (D50) of 160 nm.

Black toner particles were obtained in a manner similar to Example 14, except that the above black colorant dispersion solution was used and that polyolefin copolymer wax B was used instead of polyolefin copolymer wax A. The number-average particle size and shape coefficient of these black toner particles were again measured, and found to be 6.1 μm and 0.962 respectively.

The black toner particles were subjected to treatments using hydrophobic silica, hydrophobic titanium oxide and strontium titanate in the same method as Example 14 to obtain black toner K1.

(Examples 18 to 20)

The same manufacturing method and post treatments of the toner particles as Examples 14 to 16 were carried out to obtain toners C2, M2, and Y2 except that, in place of the IR absorbing agent given as the cyanine-based compound and the aminium-based compound, 2 parts by weight of compound 1 (represented by the general formula (I) below) as an IR absorbing agent and 3.4 parts by weight of compound 2 (represented by the general formula (II) below) as a color-suppressing agent and that polyolefin copolymer wax B was used instead of polyolefin copolymer wax A. The particle size and shape coefficient of the respective toners were: C2: 6.1 μm and 0.965; M2: 6.2 μm and 0.965; and Y2: 6.1 μm and 0.965.

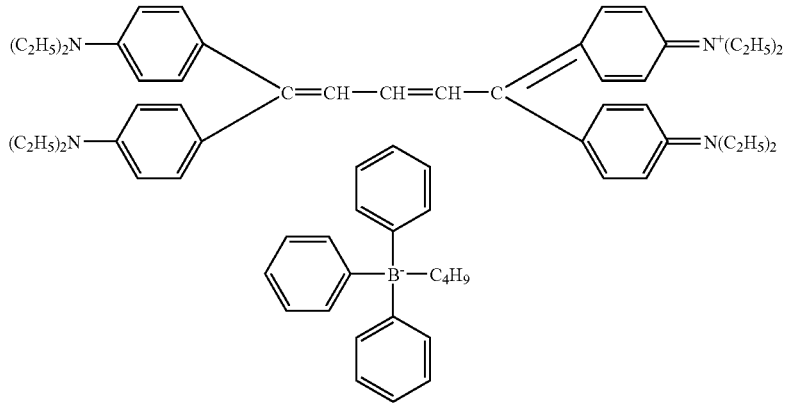

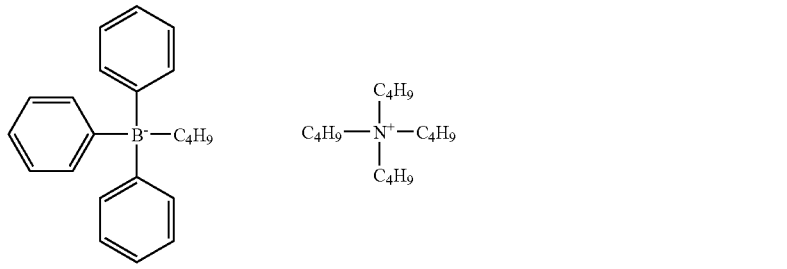

TABLE 5

| | Binder resin | Wax | | | | | IR absorbing agent Amount (parts by weight) | |
|---|---|---|---|---|---|---|---|---|
| | | First Wax (A) | | Second Wax | | | | |
| | Resin (Tg; Y) | Kind | Melting point; X | Wax (B) Wax kind | ratio A:B | X − Y (° C.) | Cyanin based | Aminium based |
| Example 14 | 62° C. | Ester A | 62° C. | Copolymer A | 6.5:1 | ±0 | 0.5 | 0.9 |
| Example 15 | 62° C. | Ester A | 62° C. | Copolymer B | 6.5:1 | ±0 | 0.6 | 0.9 |
| Example 16 | 62° C. | Ester A | 62° C. | Copolymer B | 6.5:1 | ±0 | 0.7 | 1.1 |
| Example 17 | 62° C. | Ester A | 62° C. | Copolymer B | 6.5:1 | ±0 | None (CB only) | |
| Example 18 | 62° C. | Ester A | 62° C. | Copolymer B | 6.5:1 | ±0 | 2 (compound 1) | 3.4 (compound 2) |
| Example 19 | 62° C. | Ester A | 62° C. | Copolymer B | 6.5:1 | ±0 | 2 (compound 1) | 3.4 (compound 2) |
| Example 20 | 62° C. | Ester A | 62° C. | Copolymer B | 6.5:1 | ±0 | 2 (compound 1) | 3.4 (compound 2) |

In Table 5, the amount of IR absorbing agent means a content with respect to 100 parts by weight of polymerizable monomer which constitutes a binder resin in toner particles.

(Evaluation)

Each of the magenta toners obtained in the respective examples and comparative examples was mixed with each of coat-type carriers which will be described later so as to have a toner mixing ratio of 5% by weight, and mixed at a frame for 30 minutes to form a starter.

The starter of each of the examples and comparative examples was loaded into a full-color image-forming apparatus having a non-contact fixing system, shown in FIG. 1, and mono-color images were formed. The toner amount of adhesion on the paper was 7 g/m$^2$. Each image was fixed on paper (with a xenon lamp having a light-emitting intensity of about 2.0 J/cm$^2$ and a light-emitting spectrum in a wavelength range of 810 to 840 nm), and the fixing property, color reproducibility, fogging, dot reproducibility and fine-line reproducibility of the resulting image were evaluated.

<Fixing strength (fixing property)>

The fixing property was evaluated based upon a change in image densities obtained before and after the image that had been rubbed with a sand-containing rubber eraser.

Change in image densities=(Image density after rubbing test/image density before rubbing test)×100(%)

◎: Change in image densities was not less than 90%;

○: change in image densities was not less than 80%;

Δ: Change in image densities was not less than 70% (level causing no problems in practical use); and ×: Change in image densities was less than 70%.

<Smearing preventive property>

Each image, obtained at the time of evaluating the fixing property, was rubbed against another unused copying paper under the condition of the prescribed load, and the stained state of the unused copying paper was observed, and classified into the following ranks:

ⓞ: When the loading amount was 45 g/cm$^2$, there were hardly any stains, or although stains were slightly found, they were hardly conspicuous;

○: When the loading amount was 30 g/cm$^2$, there were hardly any stains, or although stains were slightly found, they were hardly conspicuous;

Δ: When the loading amount was 30 g/cm$^2$, although stains were slightly observed, no problems were raised in practical use (level causing no problem in practical use); and ×: When the loading amount was 30 g/cm$^2$, stains were observed over the entire paper.

<Color reproducibility>

Each mono-color image on paper was visually observed with respect to the color reproducibility. The E*ab of the each image formed by the above-mentioned method was measured by a spectrocolormeter CM2000 (manufactured by Minolta, Ltd.). The each image was formed by using the IR absorbing agent free toner separately prepared and the remodeled full-color image-forming apparatus (in which a fixing device was changed to a heat-roller fixing device), and the E*ab of the image was measured. In each example or comparative example, the difference of the E*ab (⊿E*ab) was measured between the IR absorbing agent containing toner and the IR absorbing agent free toner.

ⓞ: Particularly superior in color reproducibility and E*ab ≦10;

○: Superior in color reproducibility and 10<E*ab≦15;

Δ: Although color contaminations were slightly observed, no problems were raised in practical use and it was 15<E*ab≦20; and ×: Color contaminations were observed, causing problems in image quality and it was 20<E*ab.

<Fogging>

A letter pattern image having the C/W ration of 5% on each color was copied on 10 sheets and the copied images were visually observed, and classified into the following ranks:

○: No fogging occurred;

Δ: Although fogging occurred slightly, no problems were raised in practical use; and ×: Fogging occurred over the entire paper, causing problems in image quality.

<Dot reproducibility>

An image of 2-dot halftone dot was formed in 600 dpi and the dots were visually observed through a magnifying glass (a magnifying power of 50), and classified into the ranks;

ⓞ: Particularly superior in image quality (The dots were reproduced one by one and there was hardly any dispersion of a dot size);

○: Superior in image quality (There was a small dispersion of a dot size);

Δ: No problems were raised in practical use (Although dots were separated each other and there was not loss, there was a large dispersion of a dot size); and ×: Problems were raised in image quality (There was a loss in at least one dot of the 2-dot or the 2 dots were not separated, and dots were not sufficiently reproduced).

<Fine line reproducibility>

An image of 2-dot line was formed in 600 dpi and the line image was visually observed through a magnifying glass (a magnifying power of 50), and classified into the ranks:

ⓞ: Particularly superior in image quality (The line was continuously reproduced and there was hardly any dispersion of a line width);

○: Superior in image quality (There was a small dispersion of a line width);

Δ: No problems were raised in practical use (Although there was no loss on the line image, there was a large dispersion of a line width); and ×: Problems were raised in image quality (There was a loss on the line image or a remarkably large dispersion of a line width, and line was not sufficiently reproduced).

<Heat preservation property>

Magenta toner (20 g) of each of the examples and comparative examples was put into a glass bottle, and left under a high temperature of 50° C. for 24 hours, and the resulting toner was visually observed.

○: There were no aggregated toner particles, causing no problem;

Δ: Soft aggregation was slightly observed, but easily crumbled, causing no problems in practical use; and ×: Firmly aggregated clumps were observed, and hardly crumbled to cause serious problems in practical.

TABLE 6

| | Evaluation | | | | | | |
|---|---|---|---|---|---|---|---|
| | Fixing Properties | | Color | | Dot | Fine line | Heat preservation |
| | Strength | Smearing | reproducibility | Fogging | reproducibility | reproducibility | property |
| Ex. 1 | ○ | ○ | ○ | ○ | ○ | ○ | ○ |
| Ex. 2 | ○ | ○ | ○ | ○ | ○ | ○ | ○ |
| Ex. 3 | Δ | Δ | Δ | ○ | ○ | ○ | ○ |
| Ex. 4 | ○ | ○ | ○ | ○ | ○ | ○ | ○ |
| Ex. 5 | ○ | ○ | ○ | ○ | ○ | ○ | ○ |
| Ex. 6 | ○ | ○ | ○ | ○ | ○ | ○ | ○ |
| Ex. 7 | ○ | ○ | ○ | Δ | Δ | Δ | ○ |
| Ex. 8 | Δ | Δ | ○ | ○ | ○ | ○ | ○ |
| Ex. 9 | Δ | ○ | Δ | ○ | ○ | ○ | ○ |
| Ex. 10 | ○ | ○ | ○ | ○ | ○ | ○ | Δ |
| Ex. 11 | ○ | ○ | ○ | ○ | ○ | ○ | ○ |
| Ex. 12 | ○ | ○ | ○ | ○ | ○ | ○ | ○ |

TABLE 6-continued

| | Evaluation | | | | | | |
|---|---|---|---|---|---|---|---|
| | Fixing Properties | | Color | | Dot | Fine line | Heat preservation |
| | Strength | Smearing | reproducibility | Fogging | reproducibility | reproducibility | property |
| Ex. 13 | ○ | Δ | ○ | ○ | ○ | ○ | Δ |
| Com. Ex. 1 | X | X | ○ | ○ | ○ | ○ | Δ |
| Com. Ex. 2 | ○ | ○ | ○ | X | X | X | X |
| Com. Ex. 3 | ○ | X | ○ | ○ | ○ | ○ | ○ |
| Com. Ex. 4 | X | X | X | X | X | X | X |
| Com. Ex. 5 | X | X | X | X | X | X | X |
| Com. Ex. 6 | X | X | X | X | X | X | ○ |

TABLE 7

| | Evaluation | | | | | | |
|---|---|---|---|---|---|---|---|
| | Fixing Properties | | Color | | Dot | Fine line | Heat preservation |
| | Strength | Smearing | reproducibility | Fogging | reproducibility | reproducibility | property |
| Ex. 14 | ○ | ◎ | ○ | ○ | ◎ | ◎ | ○ |
| Ex. 15 | ○ | ◎ | ○ | ○ | ◎ | ◎ | ○ |
| Ex. 16 | ○ | ◎ | ○ | ○ | ◎ | ◎ | ○ |
| Ex. 17 | ○ | ◎ | ○ | ○ | ◎ | ◎ | ○ |
| Ex. 18 | ◎ | ◎ | ◎ | ○ | ◎ | ◎ | ○ |
| Ex. 19 | ◎ | ◎ | ◎ | ○ | ◎ | ◎ | ○ |
| Ex. 20 | ◎ | ◎ | ◎ | ○ | ◎ | ◎ | ○ |

(Production of Carrier)

Coat-type carrier

To 400 ml of methylethyl ketone was dissolved 20 parts by weight of acryl-modified silicone resin KR9706 (made by Shin-Etsu Chemical Co., Ltd.) to prepare a coating solution. This coating solution was sprayed on Cu-Zn-based ferrite particles having an average particle size of 50 μm by using a spiller coater (made by Okadaseiko Co., LTD.) to form a resin coat, and heated to 180° C. for 30 minutes so as to cure the coated resin; thus, a carrier coated with the acryl-modified silicone resin was prepared. The carrier bulk was taken out, pulverized by a pulverizer, classified through a sieve of 90 μm mesh, and this was further subjected to a magnetic-force classification to remove a low-magnetic-force component; thus, a resin-coated ferrite carrier having an average particle size of 50 μm was prepared.

(Evaluation Methods for Various Physical Properties)

<Measuring method for glass transition point (Tg)>

A differential scanning calorimeter (DSC-200: made by Seiko Instruments Inc.) was used in which: 10 mg of a sample to be measured was precisely weighted, and this was put into an aluminum pan, while alumina was put into an aluminum pan so as to be used as reference, and was heated to 200° C. from normal temperature at a temperature-rise rate of 30° C./min, and this was then cooled, and subjected to measurements in the range of 20° C. to 120° C. at a temperature-rise rate of 10° C./min; thus, during this temperature-rise process, a shoulder value of the main heat-absorbing peak in the range of 30° C. to 90° C. was obtained as Tg.

<measuring method for softening point (Tm)>

A sample to be measured (1.0 g) was weighed, and a flow tested (CFT-500: made by Shimadzu Corp) was used in which: measurements were made under conditions of the application of a die having a size of h 1.0 mm×ϕ1.0 mm, a temperature-rise rate of 3.0° C./min, a pre-heating time of 180 seconds, a load of 30 kg and a measuring temperature range of 60 to 140° C., and the temperature at the time of the ½ flow of the above-mentioned sample was defined as the softening point (Tm).

<Measuring method for acid value>

With respect to the acid value, 10 mg of a sample was dissolved in 50 ml of toluene, and this was titrated by a solution of N/10 potassium hydroxide/alcohol that had been preliminarily set, using an mixed indicator of 0.1% of bromo-thymol blue and phenol red; thus, the value was calculated from the amount of consumption of the solution of N/10 potassium hydride/alcohol.

<Hydroxide value>

With respect to the hydroxide value, a weighed sample was treated by acetic anhydride, and an acetyl compound thus obtained was subjected to hydroylsis so that the number of mg of potassium hydroxide required for neutralizing isolated acetic acid was used.

<THF insoluble components>

THF insoluble components were measured by Soxhlet extraction for 10 hours using tetrahydrofran as a solvent.

The same processes as those of the manufacturing method for the magenta toner of Example 1 were carried out except that, in place of the magenta master batch, a cyan master batch corresponding to a pigment content of 5 parts by weight or a yellow master batch corresponding to a pigment content of 7 parts by weight was used and that the amounts of addition of the cyanine-based compound and the aminimum-based compound serving as IR absorbing agents were changed to the following values; thus, cyan toners 1, 2 and yellow toners 1, 2 were produced.

Cyan toner 1

Cyanine-based compound: 0.3 parts by weight
Aminium-based compound: 0.3 parts by weight Cyan toner 2

Cyanine-based compound: 0.3 parts by weight
Aminium-based compound: 0.5 parts by weight Yellow toner 1

Cyanine-based compound: 0.3 parts by weight
Aminium-based compound: 0.4 parts by weight Yellow toner 2

Cyanine-based compound: 0.3 parts by weight
Aminium-based compound: 0.5 parts by weight With respect to the above-mentioned cyan toner and yellow toner, mono-color images were formed in the same manner as the magenta toner of the above-mentioned Example 1, and the color reproducibility, fogging, dot reproducibility and fine-line reproducibility of the resulting images were evaluated. Tables 8 and 9 show the results thereof.

By using magenta toner of Example 1 as well as the above-mentioned cyan toner and yellow toner, with the amount of toner adhesion on paper having superposed three layers of colors Y, M and C being set of 21 g/m$^2$ (in the order of Y, M and C from the paper surface), the color reproducibility, fogging, dot reproducibility and fine-line reproducibility were evaluated. The results are shown on the lowermost lines of Tables 8 and 9.

By using color toners obtained in Examples 14 to 16 and Examples 18 to 20, with the amount of toner adhesion on paper having superposed three layers in a manner similar to the above being set to 21 g/m$^2$, the color reproducibility, fogging, dot reproducibility and fine-line reproducibility were evaluated. The results are shown in Table 10. In Table 10, "superposed three layers (14–16) means that cyan toner of Example 16, mazenta toner of Examples 15 and yellow toner of Example 16 were used, and "superposed three layers (18–20) means that cyan toner of Example 18, mazenta toner of Example 19 and yellow toner of Example 19 were used.

Even in the case of superposed toner layers, the toners of the present invention make it possible to provide superior properties in any of the color reproducibility, fogging preventive property, dot reproducibility and fine-line reproducibility. By using two kinds of IR absorbing agents with the amount of addition being adjusted for each of the colors, it becomes possible to provide desirable color reproducibility even in the case of an image with three colors superposed thereon.

TABLE 8

| | Color reproducibility | Fogging | Dot reproducibility | Fine line reproducibility |
|---|---|---|---|---|
| Example 1 (M) | ○ | ○ | ○ | ○ |
| Yellow toner 1 | ○ | ○ | ○ | ○ |
| Cyan toner 1 | ○ | ○ | ○ | ○ |
| Superposed three layers | ○ | ○ | ○ | ○ |

TABLE 9

| | Color reproducibility | Fogging | Dot reproducibility | Fine line reproducibility |
|---|---|---|---|---|
| Example 1 (M) | ○ | ○ | ○ | ○ |
| Yellow toner 2 | ○ | ○ | ○ | ○ |
| Cyan toner 2 | ○ | ○ | ○ | ○ |
| Superposed three layers | Δ | ○ | ○ | ○ |

TABLE 10

| | Color reproducibility | Fogging | Dot reproducibility | Fine line reproducibility |
|---|---|---|---|---|
| Superposed three layers (14–16) | ○ | ○ | ⊙ | ⊙ |
| Superposed three layers (18–20) | ⊙ | ○ | ⊙ | ⊙ |

EFFECTS OF THE INVENTION

The non-contact heat fixing toner of the present invention makes it possible to exert sufficient fixing property and image quality even in the case of small fixing energy, and consequently to provide a superior image that is free from fogging, with superior fixing strength, smearing preventive property, color reproducibility, dot reproducibility, fine-line reproducibility and heat resistance.

What is claimed is:

1. A non-contact heat fixing toner, comprising a binder resin, a colorant, an infrared absorbing agent, a first wax and a second wax, wherein a difference (X-Y) between the maximum peak temperature (X; ° C.) in the differential thermal curve in the first wax and Tg (Y; ° C.) of the binder resin is within the range from −5 to +10° C., wherein a weight ratio of the first wax to the second wax is in the range of from 3:1 to 7:1.

2. The non-contact heat fixing toner of claim 1, wherein a cyanine-based compound and an aminium-based compound are contained as an infrared absorbing agent, and weight ratio of the cyanine-based compound and the aminium-based compound being in the range from 2:1 to 1:3.

3. The non-contact heat fixing toner of claim 1, wherein the first wax is a fatty acid ester wax and the second wax is a polyolefin-based wax.

4. The non-contact heat fixing toner of claim 1, wherein the first wax has a maximum peak temperature in the differential thermal curve in the range from 55 to 75° C.

5. The non-contact heat fixing toner of claim 1, wherein the binder resin has a softening point (Tm) in the range from 90 to 110° C. and two peaks in its molecular-weight distribution.

6. The non-contact heat fixing toner of claim 1, wherein the maximum peak temperature (° C.) in the differential thermal curve in the first wax and Tg (° C.) of the binder resin is equal.

7. The non-contact heat fixing toner of claim 1, wherein the binder resin comprises a first polyester based resin and a second polyester based resin.

8. The non-contact heat fixing toner of claim 7, wherein the first polyester resin has a softening point in the range from 90 to 120° C. and the second polyester resin has a softening point in the range from 115 to 145° C.

9. The non-contact heat fixing toner of claim 7, wherein a weight ratio of the first polyester-based resin and the second polyester-based resin is in the range from 9:1 to 7:3.

10. The non-contact heat fixing toner of claim 1, wherein a melting point of the second wax is in the range from 80 to 150° C.

11. The non-contact heat fixing toner of claim 1, wherein a total content of the first and second waxes is within the range from 0.5 to 5 parts by weight with respect to 100 parts by weights of the binder resin.

12. The non-contact heat fixing toner of claim 1, wherein the toner is prepared by a wet granulation method.

13. The non-contact heat fixing toner of claim 1, wherein the infrared absorbing agent is the one which suppresses its own color by light-irradiation.

14. The non-contact heat fixing toner of claim 2, where the cyanine-based compound and the aminium-based compound are respectively used in amounts in the range of 0.1 to 1.5 parts by weight with respect to 100 parts by weight of the binder resin.

15. An image-forming method, comprising:

forming toner-images on a recording medium and fixing the toner images on the recording medium, wherein a toner comprises a binder resin, a colorant, an infrared absorbing agent, a first wax and a second wax;

a difference (X-Y) between the maximum peak temperature (X; ° C.) in the differential thermal curve in the first wax and Tg (Y; ° C.) of the binder resin being within the range from −5 to +10° C. and a weight ratio of the first wax and the second wax being in the range from 3:1 to 7:1.

16. The image-forming method of claim 15, wherein the toner is fixed by a flash fixing device provided with a flash lamp.

17. The image-forming method of claim 16, wherein the light-emitting energy of the flash lamp is in the range of 1.0 to 3.5 J/cm$^2$.

18. The image-forming method of claim 16, wherein an amount of use of infrared absorbing agent is in the range from 0.01 to 5 parts by weight with respect to 100 parts by weight of the binder resin.

19. The image-forming method of claim 16, wherein a cyanine-based compound and an aminium-based compound are contained as an infrared absorbing agent, and a weight ratio of the cyanine-based compound and the aminium-based compound being in the range from 2:1 to 1:3.

* * * * *

UNITED STATES PATENT AND TRADEMARK OFFICE

CERTIFICATE OF CORRECTION

PATENT NO. : 7,087,353 B2
APPLICATION NO. : 10/697236
DATED : August 8, 2006
INVENTOR(S) : Yoshihiro Mikuriya et al.

It is certified that error appears in the above-identified patent and that said Letters Patent is hereby corrected as shown below:

Column 32, claim 2, line 61, after “and” insert --a--.

Signed and Sealed this

Nineteenth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,087,353 B2
APPLICATION NO. : 10/697236
DATED : August 8, 2006
INVENTOR(S) : Yoshihiro Mikuriya et al.

It is certified that error appears in the above-identified patent and that said Letters Patent is hereby corrected as shown below:

Column 32, claim 2, line 61, after “and” insert --a--.

Signed and Sealed this

Twenty-sixth Day of December, 2006

JON W. DUDAS
*Director of the United States Patent and Trademark Office*